US007779618B2

(12) United States Patent
Wassenhoven et al.

(10) Patent No.: US 7,779,618 B2
(45) Date of Patent: Aug. 24, 2010

(54) FITTING RING FOR AN OPENING ROLLER OF AN OPEN-END SPINNING DEVICE

(75) Inventors: Heinz-Georg Wassenhoven, Mönchengldbach (DE); Wolfgang Meier, Mönchengldbach (DE); Lothar Winzen, Erkelenz (DE); Brigitte Riede, Mönchengldbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 201 days.

(21) Appl. No.: 12/223,800

(22) PCT Filed: Jan. 13, 2007

(86) PCT No.: PCT/EP2007/000279

§ 371 (c)(1),
(2), (4) Date: Aug. 8, 2008

(87) PCT Pub. No.: WO2007/090501

PCT Pub. Date: Aug. 16, 2007

(65) Prior Publication Data

US 2010/0154379 A1 Jun. 24, 2010

(30) Foreign Application Priority Data

Feb. 8, 2006 (DE) ..... 10 2006 005 693

(51) Int. Cl.
*D01H 4/30* (2006.01)

(52) U.S. Cl. ..... 57/408

(58) Field of Classification Search ..... 57/408; 19/114; D15/78

See application file for complete search history.

(56) References Cited

U.S. PATENT DOCUMENTS

| | | | | |
|---|---|---|---|---|
| 4,798,046 | A | 1/1989 | Stauffer et al. | 57/408 |
| 4,833,757 | A | 5/1989 | Stahlecker | 19/97 |
| 4,858,275 | A * | 8/1989 | Stahlecker et al. | 19/97 |
| 4,882,812 | A | 11/1989 | Fetzer et al. | 19/112 |
| 5,423,176 | A | 6/1995 | Stahlecker et al. | 57/408 |
| 5,428,949 | A | 7/1995 | Stahlecker et al. | 57/408 |
| 5,709,074 | A * | 1/1998 | Stahlecker | 57/408 |
| 6,865,876 | B2 * | 3/2005 | Landolt et al. | 57/408 |

FOREIGN PATENT DOCUMENTS

| | | |
|---|---|---|
| DE | 1 939 683 | 9/1970 |
| DE | 35 15 153 A1 | 11/1985 |
| DE | 3730297 A1 | 3/1989 |
| DE | 40 38 352 A1 | 6/1992 |
| DE | 42 40 026 A1 | 6/1994 |
| DE | 43 00 536 A1 | 7/1994 |
| DE | 100 54 448 A1 | 5/2002 |
| GB | 1 234 327 | 6/1971 |

* cited by examiner

*Primary Examiner*—Shaun R Hurley
(74) *Attorney, Agent, or Firm*—K&L Gates LLP

(57) ABSTRACT

Clothing ring (27) for an opening roller (21) of an open-end spinning device (1), comprising teeth (38) which are formed by at least one groove (39) incorporated in the peripheral face of a basic body (45) and running in the peripheral direction, and a plurality of indents (40) arranged substantially in the axial direction. An axial separation spacing (t) of the teeth (38) is predetermined by the groove (39) and is significantly smaller than the height (H) of the teeth (38). The teeth (38) have tooth flanks (42) which are continuously concavely curved into the groove (39).

4 Claims, 5 Drawing Sheets

FITTING RING FOR AN OPENING ROLLER OF AN OPEN-END SPINNING DEVICE

CROSS-REFERENCES TO RELATED APPLICATIONS

This application claims the benefit of German patent application 10 2006 005 693.0, filed Feb. 8, 2006, herein incorporated by reference.

BACKGROUND OF THE INVENTION

The invention relates to a clothing ring for an opening roller of an open-end spinning device.

Clothing rings for the opening rollers of open-end spinning devices have been known for a long time in various embodiments and described in numerous patent documents. Opening rollers of this type are used, in particular, to open a fiber band (commonly referred to as a sliver) supplied in spinning cans to the workstations of an open-end spinning machine into individual fibers before being fed into a spinning means, revolving at a high rotational speed, of the open-end spinning device. Opening rollers of this type rotating at a high rotational speed, for this purpose, have on their periphery, a tearing structure which combs the fiber band supplied and in the process opens it into its individual fibers. The opening rollers differ inter alia with regard to their type of production and with regard to the configuration of their tearing tools.

Opening rollers are known, for example, which have a cylindrical ring being used as a needle carrier with numerous bores to receive needles. Clothing rings of this type equipped with individual needles, which are described, for example, in U.S. Pat. No. 4,798,046, have not proven successful, however. In other words, although the most varied forms of needles were tested, as described in U.S. Pat. No. 4,798,046, these needle roller rings did not succeed in practice.

On the other hand, wire clothing rings and so-called solid rings are widespread in practice.

Solid rings of this type are described in relative detail inter alia in German Patent Publication DE-OS 1 939 683 or in German Patent Publication DE 35 15 153 C2.

As shown in these patent documents, these solid rings have a clothing which in each case is manufactured in one piece from a solid hardened steel ring. In the case of clothing rings of this type, to form the tearing tool, at least one groove running helically in the peripheral direction and a plurality of indents extending substantially orthogonally thereto are cut into the lateral surface of the clothing ring. German Patent Publication DE 35 15 153 C2 shows and describes a solid ring, in this case, in which the separation spacing of the teeth predetermined by the groove running helically is about ⅓ smaller than the tooth height produced owing to the orthogonally extending indents. The solid rings according to German Patent Publication DE-OS 1 939 683 describe clothing rings which have relatively large axial separation spacings between the teeth and are equipped with teeth, the tooth height of which is relatively small, in other words, in these known clothing rings, the ratio of separation spacing/tooth height is about 4/1. Solid rings with a configuration as described in German Patent Publication DE-OS 1 939 683 were, however, not able to be successful on the market as the transporting behavior of these clothing rings proved to be inadequate, above all, because of the relatively small tooth height.

Even though solid rings in general are not only distinguished by a long service life, but also by good functionality, it is known that the combing out and transporting behavior of such clothing rings can be influenced by the shaping of the teeth, in particular by a special configuration of the tooth flanks of the teeth and/or the groove arranged between the teeth.

Clothing rings are described, for example, in German Patent Publication DE 100 54 448 A1, in which the groove arranged between the teeth is V-shaped to achieve particularly good drawing of the fibers during their transportation through the opening roller housing. In other words, the tooth flanks of the teeth, which are configured linearly and arranged at an inclination of <5° with respect to the tooth centre plane, pass into the side walls of the V-shaped groove with the formation of a bend edge. The side walls of the groove thus have an inclination of about 40° with respect to the tooth centre plane.

Clothing rings with teeth are also known from German Patent Publication DE 42 40 026 A1 and German Patent Publication DE 40 38 352 A1, in which, to achieve a combing out of the so-called fiber tuft of the fed fiber band, which is as good as possible and gentle, the tooth flanks are provided with a surface structure.

German Patent Publication DE 40 38 352 A1 in this case describes clothing rings, in which only the region of the tooth flanks has a surface structure of this type, while the surface in the region of the semi-circular groove arranged between the teeth is smooth.

In the clothing rings according to German Patent Publication DE 42 40 026 A1, not only the tooth flanks have a special profiling, but also the groove arranged between the teeth is provided with a corresponding profiling.

Finally, clothing rings are known from German Patent Publication DE 43 00 536 A1, which, between the teeth, have a helically running groove with a concavely curved groove base, adjoined by side walls of the groove arranged in an inclined manner.

The angle of inclination of the side walls of the groove, based on the centre plane of the teeth is about 15°. The tooth flanks of the teeth adjoin the side walls of the groove, in each case, similarly to the clothing rings according to German Patent Publication DE 100 54 448 A1, the angle of inclination of the tooth flanks being significantly smaller than the angle of inclination of the side walls of the groove. A configuration of this type leads to a bend edge also being produced here in each case between the side walls of the groove and the tooth flanks of the teeth. A bend edge of this type has a disadvantageous effect on the combing out behavior of the clothing ring. In other words, the fiber separation during the fiber band opening is to some extent inadequate, or inadequately uniform, in these known clothing rings.

SUMMARY OF THE INVENTION

Proceeding from the aforementioned prior art, the invention is based on the object of providing clothing rings which allow a uniform, gentle combing out of the fibers from a feed fiber band. In addition, the clothing rings according to the invention should ensure proper transportation of the combed-out individual fibers within the opening roller housing and their reliable transfer to a fiber guide channel.

According to the invention, this object is achieved by a clothing ring for an opening roller of an open-end spinning device, with teeth which are formed by at least one groove incorporated in the peripheral face of a basic body and running in the peripheral direction, and a plurality of indents arranged substantially in the axial direction, the axial separation spacing of the teeth predetermined by the groove being significantly smaller than the height of the teeth. According to the present invention, the teeth have tooth flanks which are continuously concavely curved into the groove.

Further advantageous embodiments of the invention are more fully described hereinafter.

The configuration of a clothing ring according to the invention, in which the axial separation spacing of the teeth predetermined by the peripheral groove is significantly smaller than the height of the teeth and the teeth have tooth flanks, which are continuously concavely curved into the groove, has the advantage that no edges or the like which, on the one hand, damage the fibers and, on the other hand, impair the transportation flow within the opening roller housing, are present in the region of the tooth flanks, via which, as is known, a large part of the opening and transportation work of the fibers takes place.

In other words, by avoiding a bend edge between the tooth flanks and the side walls, a gentle and uniform opening of the individual fibers is achieved, in particular in sensitive synthetic yarns.

An embodiment in which the curvature of the tooth flanks continuously becomes smaller toward the tip of the tooth proceeding from the base of the groove respectively arranged between two teeth, has proven to be particularly advantageous with regard to gentle fiber band opening of sensitive yarns. A clothing ring configured in this manner does not only comb the individual fibers particularly gently from the feed fiber band, but also leads to a very uniform transporting air flow circulating between the tooth flanks and the side walls.

According to one aspect of the invention, a tangent placed in the region of the groove base on the tooth flank in this case preferably encloses an angle $\alpha$, which is 90°, with respect to the centre plane of the tooth. A corresponding tangent placed in the region of the tooth crest on the tooth flank, on the other hand, has an angle $\alpha$ of 0° with regard to the centre plane of the tooth. The tooth flanks in the region of the groove, in this case, preferably already have a relatively large part of the overall curvature. This curvature then becomes less and less toward the tooth crest.

As corresponding measurements have shown, clothing rings which have the above-described tooth shape, in particular in synthetic material, lead to yarns with improved yarn-dynamic test values. In other words, the yarns produced with the clothing rings according to the invention, compared to yarns which have been produced with known clothing rings, have a higher yarn strength.

According to another aspect of the invention, the tooth flank has the largest part of the curvature, in other words more than 50%, on the first seventh of its overall length, viewed from the groove base. The relatively strong curvature in the region of the groove leads to a relatively wide groove on the entire cross section, which favors the production of an undisturbed transporting air flow.

Preferably, the groove running helically in the peripheral direction of the clothing ring and the indents arranged in the axial direction have the same depth. A configuration of this type ensures that during production of the clothing rings, no edges or channels are produced on which fibers could collect in an uncontrolled manner during operation.

According to another aspect of the invention, the configuration of the tooth flanks according to the invention is particularly advantageous when the ratio of the tooth height to the axial separation spacing of the teeth is about 4 to 1, in other words if many long tooth flanks which are free of disrupting bend edges are present.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
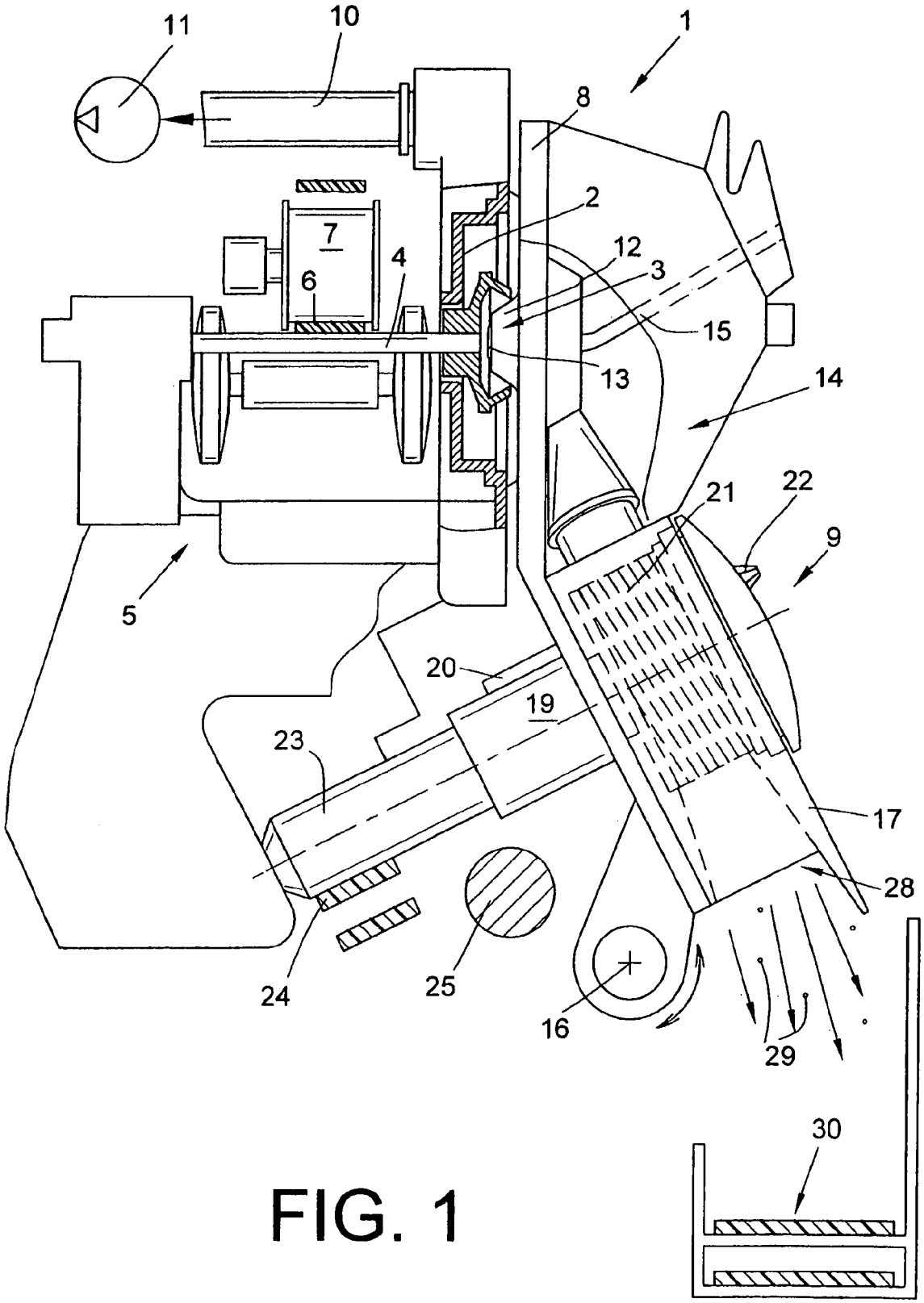
FIG. 1 shows a schematic side view of an open-end spinning device with an integrated fiber opening mechanism, the opening roller of which is equipped with a clothing ring according to the invention.

The open-end rotor spinning device 1 shown in FIG. 1 has, as known, a rotor housing 2 in which a spinning rotor 3 revolves at a high rotational speed. The spinning rotor 3 is in this case supported by its rotor shaft 4 in the interspace of a support disc mounting 5 and is acted upon by a tangential belt 6 along the length of the machine, which belt is set by a pressure roller 7. The rotor housing 2, which is open at the front per se, is closed during operation by a pivotably mounted cover element 8. The rotor housing 2 is also connected by means of a corresponding pneumatic line 10 to a negative pressure source 11, which produces the negative spinning pressure necessary in the rotor housing 2. A so-called channel plate adaptor 12 which has a yarn draw-off nozzle 13 and the opening region of a fiber guide channel 14, is arranged in a receiving opening, not shown in more detail, of the cover element 8. A yarn draw-off tube 15 adjoins the yarn draw-off nozzle 13 here.

A fiber band opening mechanism designated by a whole by the reference numeral 9, is fixed on or in the cover element 8, which is mounted so as to be rotatable to a limited extent about a pivot pin 16. The fiber band opening mechanism 9 has, as essential components, an opening roller 21 rotating in an opening roller housing 17 and a fiber band feed cylinder 22 which is also rotatably mounted. Opening rollers 21 of this type, which generally revolve during the spinning process at rotational speeds of between 6000 and 12000 rpm, have the task of opening a feed fiber band 18 supplied by the fiber band feed cylinder 22 into individual fibers 26. The opening roller 21 and the fiber band feed cylinder 22 are mounted in rear bearing brackets 19, 20 of the cover element 8. The opening roller 21 is driven in this case in the region of its wharve 23 by a revolving tangential belt 24 along the length of the machine, while the fiber band feed cylinder 22 is preferably driven by a worm gear arrangement (not shown), which is connected on a drive shaft 25 along the length of the machine.

Both the opening roller 21 and the fiber band feed cylinder 22 can obviously also be driven by a single motor. In a case such as this, corresponding stepping motors which can be activated in a defined manner are preferably used.

The opening roller housing 17 has, in its lower region, a debris outlet opening 28 arranged in the rotational direction R of the opening roller 21 behind the fiber band feed cylinder 22. The debris particles 29 released from the feed fiber band, as known, are eliminated via this debris outlet opening 28 and disposed of by means of a schematically shown debris disposal mechanism 30.

Figure 2:
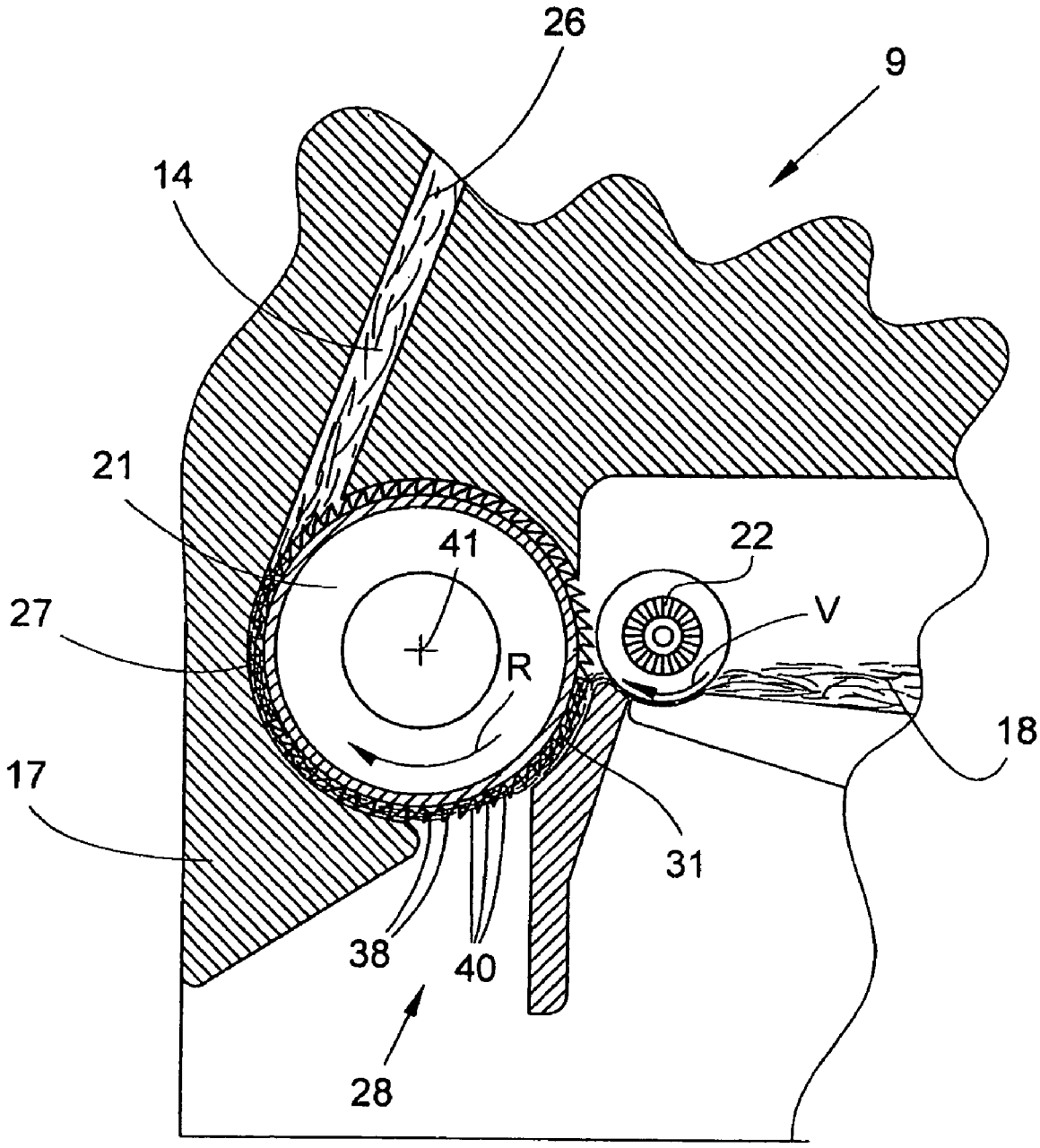
FIG. 2 shows a fiber opening mechanism with an opening roller in a front view, partially in section.

FIG. 2 schematically shows, in a front view, a fiber band opening mechanism 9 with an opening roller 21 rotating in an opening roller housing 17. The opening roller 21, during its rotation in the direction of the arrow R, combs out a fiber band 18 fed by the fiber band feed cylinder 22, which rotates in the direction of the arrow V, into individual fibers 26, which are then fed via the fiber guide channel 14 onto a spinning rotor 3, not shown in FIG. 2. As indicated, the opening roller 21, during its rotation with its clothing ring 27 configured as a tearing tool, combs through the feed fiber band 18, which, in the region arranged behind the fiber band feed cylinder 22, forms a so-called fiber tuft 31. The opening roller 21 rotating at a high rotational speed accelerates the combed-out individual fibers 26 to the revolving speed of the opening roller 21 and transports them into the region of the fiber guide channel 14, where they are pneumatically detached because of the negative spinning pressure prevailing in the rotor housing 2.

As indicated, the clothing ring 27 has a large number of teeth, which are in each case formed by a groove 39 running helically in the peripheral direction of the opening roller 21, and indents 40 extending substantially parallel to the axis of rotation 41.

Figure 3:
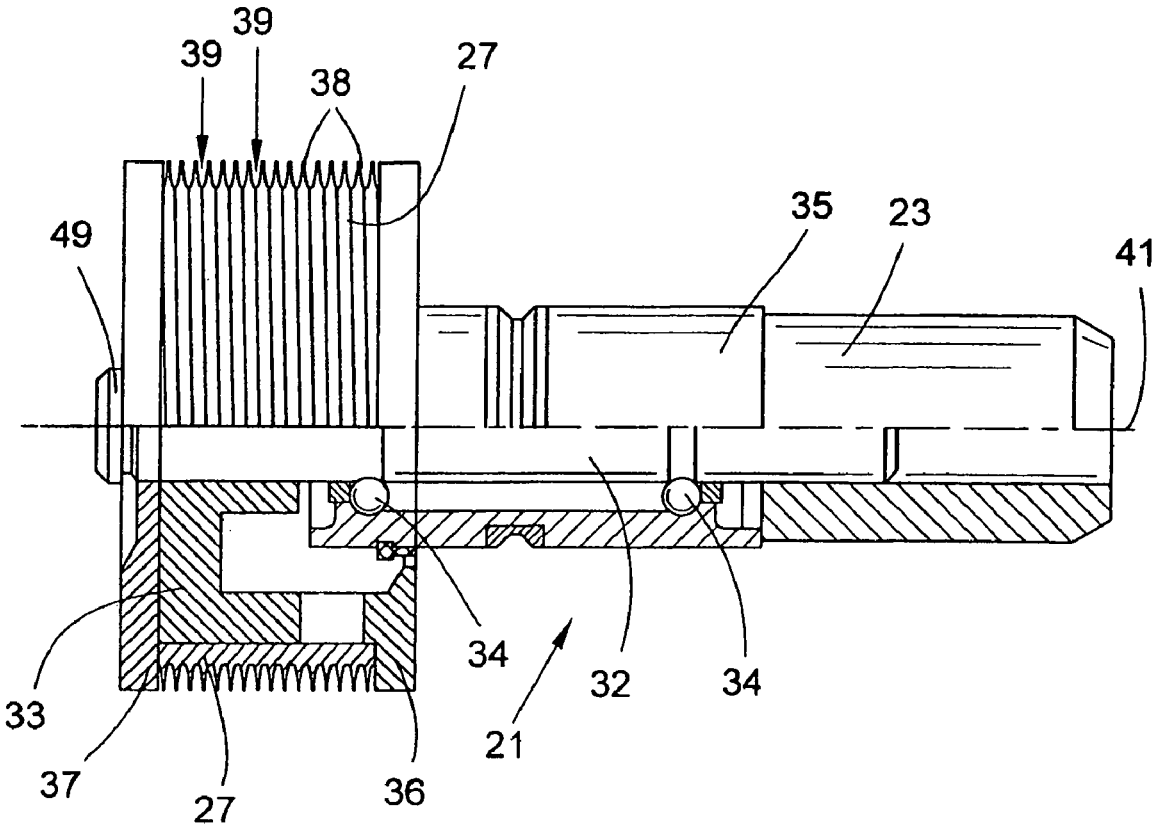
FIG. 3 shows a side view, partially in section, of an opening roller with a clothing ring.

FIG. 3 shows an opening roller 21 in a side view, partially in section. As can be seen, an opening roller 21 of this type consists of a central roller body 33, which is non-rotationally arranged on a shaft 32 by means of a press fit, a drive wharve 23 also being fixed to the shaft 32. The clothing ring 27 according to the invention is preferably non-positively fixed in its installation position on the roller body 33 between annular collars 36, 37. The annular collar 37 is detachably arranged here and can be fixed on the roller body 33 by means of a screw bolt 49 or the like.

The opening roller 21 which can be freely rotated about the rotational axis 41 is also, as usual, supported by means of roller bearings 34 in a bearing housing 35, which can in turn be fixed in the bearing bracket 19 of the cover element 8.

Figure 4:
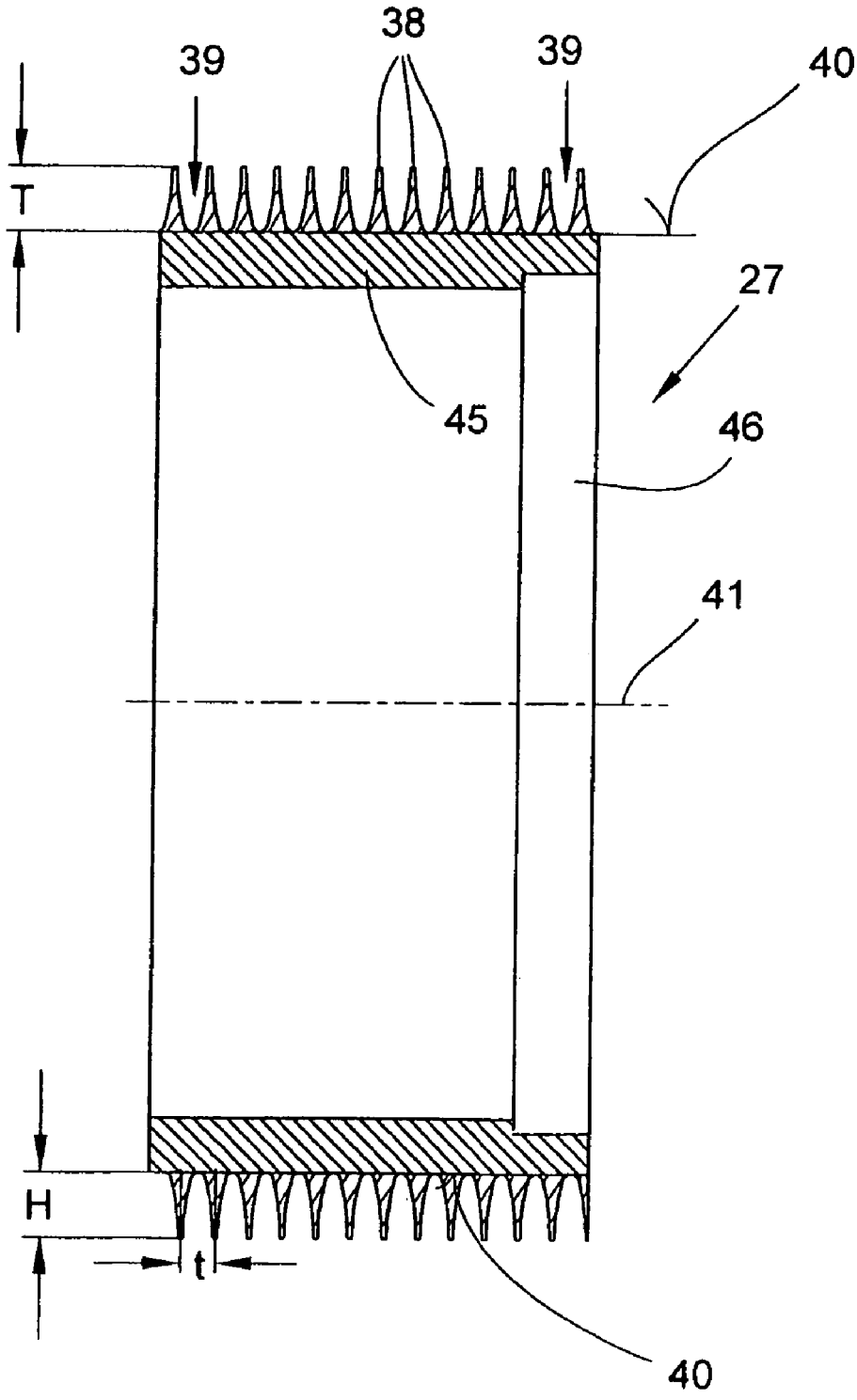
FIG. 4 shows a clothing ring according to the invention in section.

As shown in FIG. 4, the clothing ring 27 according to the invention which is preferably manufactured as a solid ring and produced from steel, for example, consists substantially of a tubular basic body 45 with an annular centring shoulder 46 in the region of its internal diameter. As can be seen, the clothing ring 27 is configured as a tearing tool on its outer periphery. In other words, in the region of the outer periphery of the clothing ring 27, a large number of teeth 38 are arranged, which are formed by milling in a groove 39 running helically in the peripheral direction and indents 40 running substantially parallel to the rotational axis 41. The groove 39 and the indents 40 preferably have a depth T.

Figure 5:
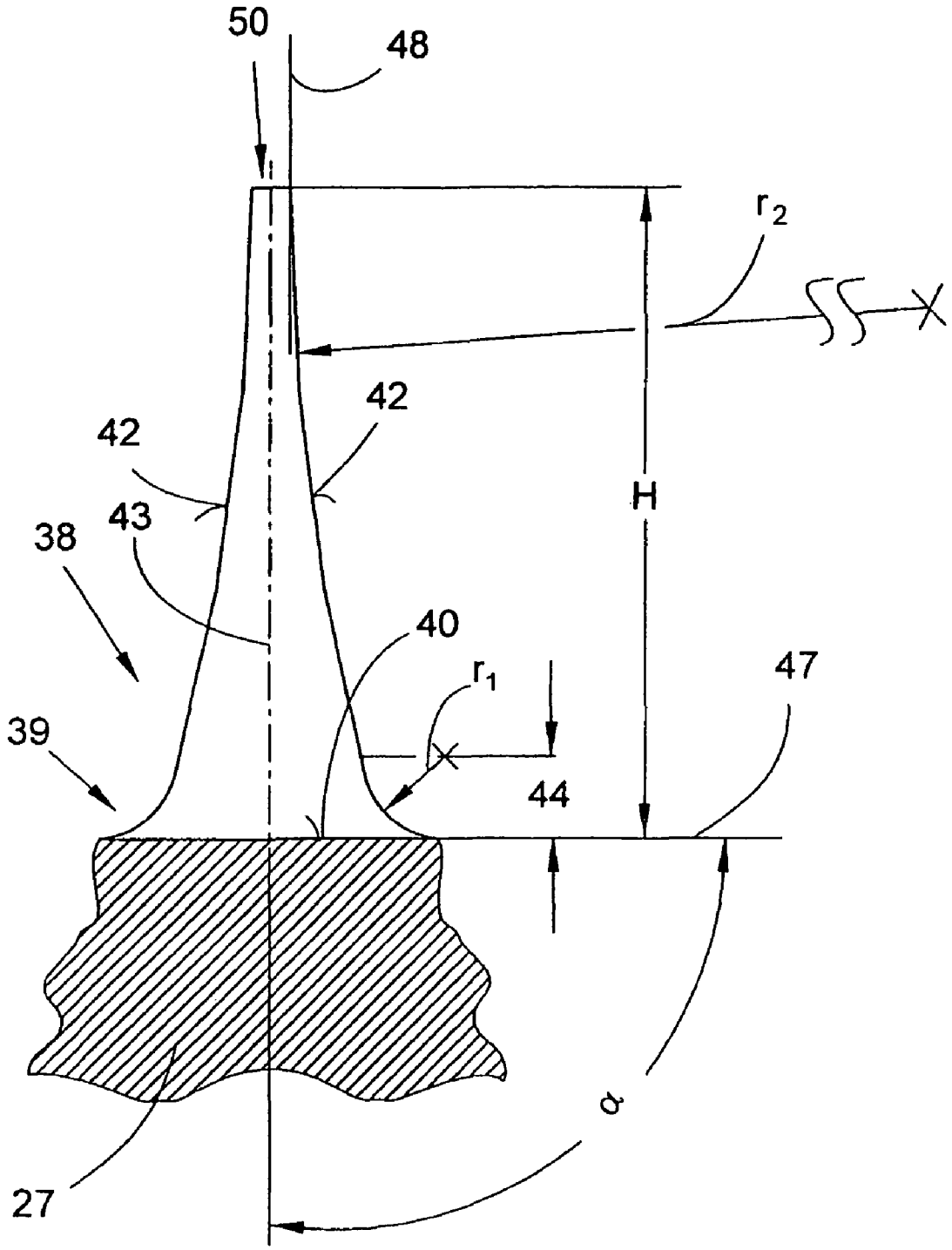
FIG. 5 shows a front view of a tooth of the clothing ring according to the invention.

As can be seen in particular from FIG. 5, the teeth 38 which are arranged at a separation spacing t and have a tooth height H, have lateral tooth flanks 42, which are concavely curved with respect to the tooth centre plane 43.

The curvature of the tooth flanks 42 in this case has a radius $r_1$ in the region characterized by the reference numeral 44, which radius is preferably about 0.5 mm. Adjoining the region 44, the tooth flanks 42 have a curvature, the radius $r_2$ of which is about 11 mm.

As further indicated in FIG. 5, the angle $\alpha$ between a tangent 47, which is placed in the region of the groove base on the tooth flank 42, and the centre plane 43 of the tooth 38 is 90°. In the region of the tooth crown 50, the angle of a tangent 48, which is placed on the tooth flank 42, and the centre plane 43 of the tooth 38 is 0°, on the other hand. In other words, the curvature of the tooth flanks 42 tapers off continuously toward the tooth crown 50.

What is claimed is:

1. Clothing ring (27) for an opening roller (21) of an open-end spinning device (1), comprising teeth (38) which are formed by at least one groove (39) incorporated in the peripheral face of a basic body (45) and running in the peripheral direction, and a plurality of indents (40) arranged substantially in the axial direction, an axial separation spacing (t) of the teeth (38) being predetermined by the groove (39) and being significantly smaller than the height (H) of the teeth (38), characterized in that the teeth (38) have tooth flanks (42) which are continuously concavely curved into the groove (39), wherein the curvature of the tooth flanks (42), proceeding from the base of the groove (39) respectively arranged between two teeth (38), becomes continuously smaller toward the tip (50) of the tooth and wherein tangents (47, 48) placed on the tooth flanks (42) enclose angles $\alpha$ with respect to the centre plane (43) of the tooth (38), which are 90° in the region of the groove base and virtually 0° in the region of the tooth crest (50).

2. Clothing ring according to claim 1, characterized in that the tooth flank (42) has greater than 50% of the curvature on the first seventh (44) of its height (H) viewed from the groove base.

3. Clothing ring according to claim 1, characterized in that the groove (39) arranged helically and running in the peripheral direction of the clothing ring (27) and the indents (40) arranged in the axial direction have virtually the same depth (T).

4. Clothing ring according to claim 1, characterized in that the height (H) of the teeth (38) is approximately twice as great as the axial separation spacing (t) between the teeth (38).

* * * * *